US006777873B2

(12) United States Patent
Hashikawa

(10) Patent No.: US 6,777,873 B2
(45) Date of Patent: Aug. 17, 2004

(54) PLASMA DISPLAY PANEL

(75) Inventor: Hirokazu Hashikawa, Yamanashi-ken (JP)

(73) Assignee: Pioneer Corporation, Tokyo (JP)

( * ) Notice: Subject to any disclaimer, the term of this patent is extended or adjusted under 35 U.S.C. 154(b) by 0 days.

(21) Appl. No.: 10/378,812

(22) Filed: Mar. 5, 2003

(65) Prior Publication Data

US 2003/0168977 A1 Sep. 11, 2003

(30) Foreign Application Priority Data

Mar. 6, 2002 (JP) ..... 2002-060071

(51) Int. Cl.[7] ..... H01J 17/49

(52) U.S. Cl. ..... 313/582; 313/584; 313/586

(58) Field of Search ..... 313/582, 584, 313/586, 587

*Primary Examiner*—Vip Patel
(74) *Attorney, Agent, or Firm*—Arent Fox

(57) ABSTRACT

Bus electrodes Xa, Ya, transparent electrodes Xb, Yb, and column electrode protrusions Db are formed on a front glass substrate 1. A leading end of the transparent electrode Xb (Yb) is opposite another leading end of the transparent electrode Yb (Xb), connected to the bus electrode Ya (Xa) adjacent thereto, with a first discharge gap g1 interposed in between. One or other of the transparent electrodes Yb and Xb is opposite the column electrode protrusion Db with a second discharge gap g2 in between. A column electrode body Da is separated from the bus electrodes Xa and Ya through the first dielectric layer 2. A phosphor layer 6 is provided on a back glass substrate 4.

13 Claims, 6 Drawing Sheets

W—W SECTION

W—W SECTION

V—V SECTION

PLASMA DISPLAY PANEL

BACKGROUND OF THE INVENTION

1. Field of the Invention

This invention relates to a panel structure of a surface-discharge-type alternating-current plasma display panel.

The present application claims priority from Japanese Application No. 2002-60071, the disclosure of which is incorporated herein by reference.

2. Description of the Related Art

At the present time, surface-discharge-type AC plasma display panels (hereinafter referred to as "PDP") have received attention as a large-sized flat color-screen display, and have increasingly become commonly used in ordinary homes.

A reflection-type PDP of a three electrode structure is well known as one kind of surface-discharge-type AC PDP.

The three-electrode reflection-type PDP includes a front glass substrate and a back glass substrate which are situated opposite each other with a discharge-gas-filled discharge space in between.

The front glass substrate has an inner surface on which a plurality of row electrode pairs and a dielectric layer covering the row electrode pairs are provided. The row electrode pair is constituted of paired row electrodes (discharge sustaining electrodes) extending in a row direction and arranged in parallel to each other to form a display line.

The back glass substrate has an inner surface on which a plurality of column electrodes (addressing electrodes) extend in the column direction.

A discharge cell (unit light emitting area) is formed at each intersection of the column electrode and the row electrode pair in the discharge space, and has a red-, green- or blue-colored phosphor layer formed therein.

In the three-electrode reflection-type PDP, first, an addressing discharge is selectively produced between one row electrode in the row electrode pair and the column electrode to form wall charges on the dielectric layer covering the row electrode pair or to erase the wall charges formed thereon.

As a result of the addressing discharge, the discharge cells in which the wall charges are generated on the dielectric layer (lighted cells) and the discharge cells in which no wall charges are generated on the dielectric layer (non-lighted cells) are distributed over the panel surface in accordance with an inputted video signal.

After that, a sustaining discharge is caused between the row electrodes of each row electrode pair in the lighted cells. The sustaining discharge causes radiation of vacuum ultraviolet light from a xenon gas included in the discharge gas. The vacuum ultraviolet light excites the red, green or blue phosphor layer formed in each lighted cell to allow the phosphor layer to emit light for the matrix display of an image.

The conventional configuration of the three-electrode reflection-type PDP as described above requires a complicated manufacturing process for forming the electrodes on both the front and back glass substrates, and also high precision for the positional relationship between the electrodes provided on the front and back glass substrates.

Such requirements give rise to the problem of an increase in manufacturing costs. The large number of components formed on each substrate has the disadvantage of further increasing the manufacturing costs.

In recent years, therefore, in order to reduce the cost and increase the high definition of the display image, a PDP having the row electrodes and the column electrodes formed on either the front or the back glass substrate has been suggested.

The PDP of the above type is designed such that the row electrode pair and the column electrode extending in the direction at right angles to the row electrode pair concerned are formed in a double layer construction with the dielectric layer interposed in between, on a glass substrate situated opposite another glass substrate having the phosphor layer formed thereon.

However, as compared with the case in which the row electrode pairs and the column electrodes are formed separately on the two facing glass substrates, the formation of the row electrode pairs and the column electrodes on the same single glass substrate leads to a decrease in a distance between the row electrode pair and the column electrode, and accordingly the capacitance arising from the intersection of the row electrode pair and the column electrode is much higher. The extremely high capacitance creates a bottleneck in the commercialization of the PDP having the row electrode pairs and the column electrodes formed on the same single glass substrate.

SUMMARY OF THE INVENTION

The present invention has been made to solve the problems associated with the three-electrode surface-discharge-type alternating-current plasma display panels as described above.

Accordingly, it is an object of the present invention to provide a plasma display panel having the form that row electrode pairs and column electrodes are formed on one or other of substrates, and capable of reducing capacitance arising from intersection of the row electrode pair and the column electrode for the sake of commercialization.

It is another object of the present invention to provide a plasma display panel having a reduced number of components for cost reduction.

To attain these objects, according to a first feature of the present invention, a plasma display panel including: a pair of first and second substrates opposite each other with a discharge space in between; a plurality of row electrode bodies provided on an inner surface of the first substrate, and each extending in a row direction and arranged at required intervals in a column direction; a plurality of row electrode jutting parts provided on the inner surface of the first substrate, and connected to each of the row electrode bodies at required intervals, and each protruding from the row electrode body in the column direction on both sides of the row electrode body; a plurality of column electrodes provided on the inner surface of the first substrate, and each separated from the row electrode body through a dielectric layer, covering the row electrode bodies and the row electrode jutting parts, in a thickness direction of the first substrate, and also disposed opposite a midpoint of the row electrode jutting parts adjacent to each other in the row direction, a leading end of each of the row electrode jutting parts being opposite a leading end of another row electrode jutting part, connected to the row electrode body adjacent thereto, with a first discharge gap interposed in between, one of the row electrode jutting parts facing and paired with each other being opposite the column electrode with a second discharge gap interposed in between; and phosphor layers each provided on a surface of the second substrate, facing the first substrate, and at a position opposite the paired row electrode jutting parts placed opposite each other with the first gap in between.

The plasma display panel according to the first feature has discharge cells formed within the discharge space defined between the two substrates, and each opposite the paired row electrode jutting parts opposite to each other with the first discharge gap in between.

In an addressing period after completion of a concurrent reset period, a scan pulse is applied to the row electrode bodies in sequence, and a display data pulse corresponding to display data of a video signal is applied to the column electrodes. An addressing discharge is then selectively produced in the second discharge gap between the column electrode and the row electrode jutting part which is connected to the row electrode body and opposite the column electrode concerned. As a result, the discharge cells in which wall charges are generated on the dielectric layers (lighted cells) and the discharge cells in which no wall charge is formed thereon (non-light cells) are distributed over the panel surface.

In the subsequent sustaining emission period, a discharge-sustaining pulse is applied to the row electrode bodies to cause a sustaining discharge between the row electrode jutting parts paired opposite to each other with the first discharge gap in between in each lighted cell.

The sustaining discharge allows in each lighted cell radiation of vacuum ultraviolet light from a xenon gas included in a discharge gas sealed in the discharge space. The vacuum ultraviolet light excites the red-, green- or blue-colored phosphor layer formed on the second substrate to allow the phosphor layer to emit light for the matrix display of an image.

According to the first feature, in between the adjacent display lines (lines each extending in the row direction in which the paired row electrode jutting parts are arranged), the row electrode jutting parts share the use of the single row electrode body. That is, only one row electrode body is disposed between the adjacent display lines. This design decreases the number of intersections of the row electrode bodies and the column electrodes to approximately half for reduction in the opposition area in the intersections. Hence capacitance arising from between the row electrode bodies and the column electrodes is significantly reduced.

Thus, it becomes possible to proceed toward the commercialization of plasma display panels of a form having three electrodes formed on one or other of the substrates.

Further, according to the first feature, the area of the non-display zone of the PDP between adjacent display lines has the advantage of being approximately equal to the area of one row electrode body. This fact successfully reduces the spacing between the display lines to permit an increase in the definition of an image to be generated, and also an increase in the area of the display zone of each display cell for the improvement of the luminous efficiency.

Still further, according to the first feature, the formation of the row electrodes and the column electrodes on the first substrate simplifies the configuration of the second substrate, resulting in the simplification of the manufacturing process and cost reduction. In addition, the row electrode jutting part and the column electrode are placed near each other and also the addressing discharge between the row electrode jutting part and the column electrode is produced without intervention of the phosphor layer. These facts make it possible to decrease the addressing-discharge starting voltage to enhance the addressing margin, and further to suppress the deterioration of the phosphor layer caused by the ion attack in the addressing discharge.

To attain the aforementioned objects, the plasma display panel has, in addition to the configuration of the first feature, a second feature in which at least one of the two, either the column electrode or the row electrode body, has a width of a portion intersecting with the column electrode or the row electrode body smaller than that of other portions thereof.

According to the second feature, the intersection and opposition area of the column electrode and the row electrode body is further decreased. Due to the reduction in this area, the capacitance arising from between the column electrode and the row electrode body is further reduced.

To attain the aforementioned objects, the plasma display panel has, in addition to the configuration of the second feature, a third feature in which the row electrode body has the width of the portion intersecting with the column electrode smaller than that of the other portions thereof.

According to the third feature, the intersection and opposition area of the column electrode and the row electrode body is advantageously decreased to reduce the capacitance arising from between the column electrode and the row electrode body.

To attain the aforementioned objects, the plasma display panel has, in addition to the configuration of the second feature, a fourth feature in which the column electrode has the width of the portion intersecting with the row electrode body smaller than that of the other portions thereof.

According to the fourth feature, a further decrease in the intersection and opposition area of the column electrode and the row electrode body is achieved. Thus, a further reduction in the capacitance arising from between the column electrode and the row electrode body is provided.

To attain the aforementioned objects, the plasma display panel has, in addition to the configuration of the second feature, a fifth feature in which the column electrode and the row electrode body each have the width of the portion intersecting with the other smaller than the width of other portions thereof.

According to the fifth feature, an even further decrease in the intersection and opposition area of the column electrode and the row electrode body is achieved. Thus, the capacitance arising from between the column electrode and the row electrode body is further reduced.

To attain the aforementioned objects, the plasma display panel has, in addition to the configuration of the first feature, a sixth feature in which the column electrode has a column electrode body extending in the column direction, and column electrode protrusions each electrically connected to the column electrode body and each located opposite the row electrode jutting part, connected to one of the paired row electrode bodies, with the second discharge gap interposed in between.

According to the sixth feature, the display data pulse applied to the column electrode body is conducted to the column electrode protrusion, and thus the addressing discharge is produced between the column electrode protrusion concerned and the row electrode jutting part which are opposite each other with the second discharge gap in between.

To attain the aforementioned objects, the plasma display panel has, in addition to the configuration of the sixth feature, a seventh feature in which the row electrode body and the row electrode jutting part are covered with a first dielectric layer, and at least the column electrode body of the column electrode is covered with a second dielectric layer formed on a back surface of the first dielectric layer.

According to the seventh invention, the row electrode is insulated from the column electrode by covering the row electrode body and the row electrode jutting part with the first dielectric layer and covering the column electrode body of the column electrode with the second dielectric layer.

To attain the aforementioned objects, the plasma display panel has, in addition to the configuration of the seventh feature, an eighth feature in which the first dielectric layer has a thickness larger than that of the second dielectric layer.

According to the eighth feature, the fact that the first dielectric layer interposed between the row electrode body and the column electrode body has a thickness larger than that of the second dielectric layer allows a further reduction in the capacitance arising from between the row electrode body and the column electrode body.

To attain the aforementioned objects, the plasma display panel has, in addition to the configuration of the sixth feature, a ninth feature in which the column electrode protrusion is formed to be flush with the row electrode jutting part, and coupled to the column electrode body.

According to the ninth feature, the display data pulse applied to the column electrode body is conducted to the column electrode protrusion, and thus the addressing discharge is caused between the column electrode protrusion concerned and the row electrode jutting part which are opposite to each other with the second discharge gap in between.

To attain the aforementioned objects, the plasma display panel has, in addition to the configuration of the sixth feature, a tenth feature in which the column electrode protrusion is formed to be flush with the column electrode body and coupled to the column electrode body concerned.

According to the tenth feature, the display data pulse applied to the column electrode body is conducted to the column electrode protrusion, and thus the addressing discharge is caused between the column electrode protrusion concerned and the row electrode jutting part which are opposite to each other with the second discharge gap in between.

To attain the aforementioned objects, the plasma display panel has, in addition to the configuration of the sixth feature, an eleventh feature in which the column electrode protrusion is formed to be flush with the row electrode jutting part, and coupled to the column electrode body through the dielectric layer in terms of capacitance.

According to the eleventh feature, the display data pulse applied to the column electrode body is conducted to the column electrode protrusion by capacitance, and thus the addressing discharge is caused between the column electrode protrusion concerned and the row electrode jutting part which are opposite to each other with the second discharge gap in between.

To attain the aforementioned objects, the plasma display panel has, in addition to the configuration of the sixth feature, a twelfth feature in which the row electrode jutting part has a base end connected to the row electrode body and having a width smaller than that of the leading end thereof in the row direction, and the widened heads of the leading ends are opposite each other with the first discharge gap in between, and the column electrode protrusion is formed opposite the widened head of the row electrode jutting part.

According to the twelfth feature, the addressing discharge caused between the column electrode protrusion and the widened head of the row electrode jutting part which are opposite to each other with the second discharge gap in between is improved in discharge efficiency to decrease occurrence of false discharge (false emission) and also reduce an addressing driving voltage.

To attain the aforementioned objects, the plasma display panel has, in addition to the configuration of the first feature, a thirteenth feature of further including a partition wall provided on the surface of the second substrate facing the first substrate and opposite at least one of the row electrode body and the column electrode, and extending in one of the row and column directions to partition the discharge space defined between the first and second substrates.

According to the thirteenth feature, the present invention provides an increase in the opening area of the discharge cell because either one or both of the row electrode body and column electrode is situated opposite the partition wall partitioning the discharge space.

These and other objects and features of the present invention will become more apparent from the following detailed description with reference to the accompanying drawings.

DETAILED DESCRIPTION OF THE PREFERRED EMBODIMENT

Preferred embodiments according to the present invention will be described hereinafter in detail with reference to the accompanying drawings.

Figure 1:
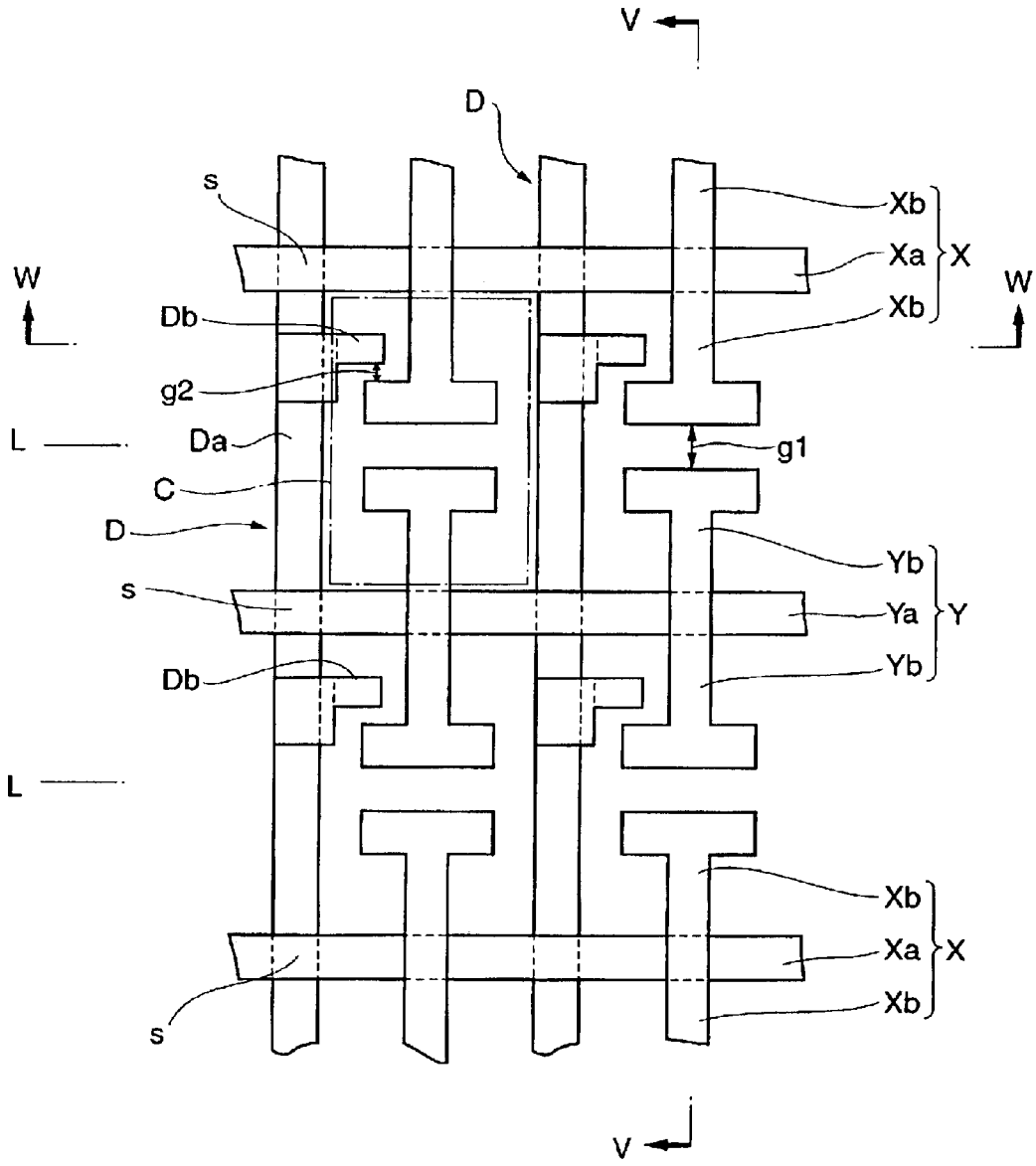
FIG. 1 is a schematic front view illustrating a first embodiment according to the present invention.
Figure 2:
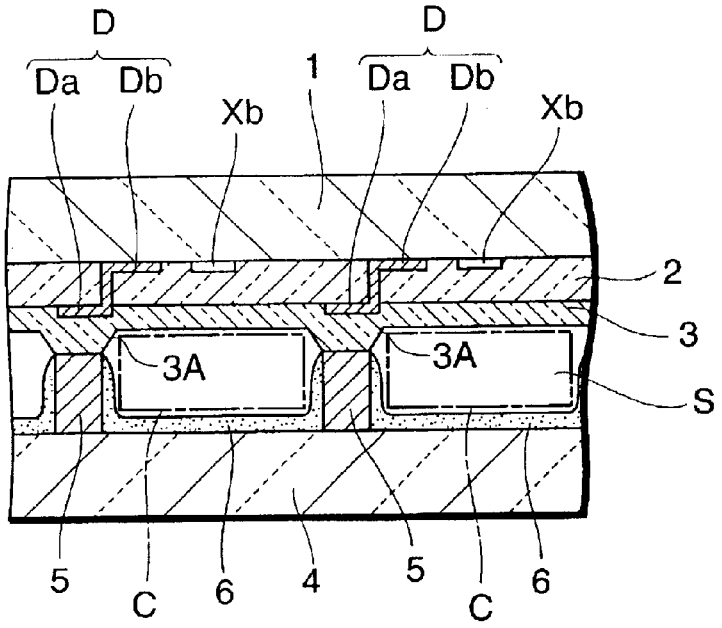
FIG. 2 is a sectional view taken along the W–W line of FIG. 1.
Figure 3:
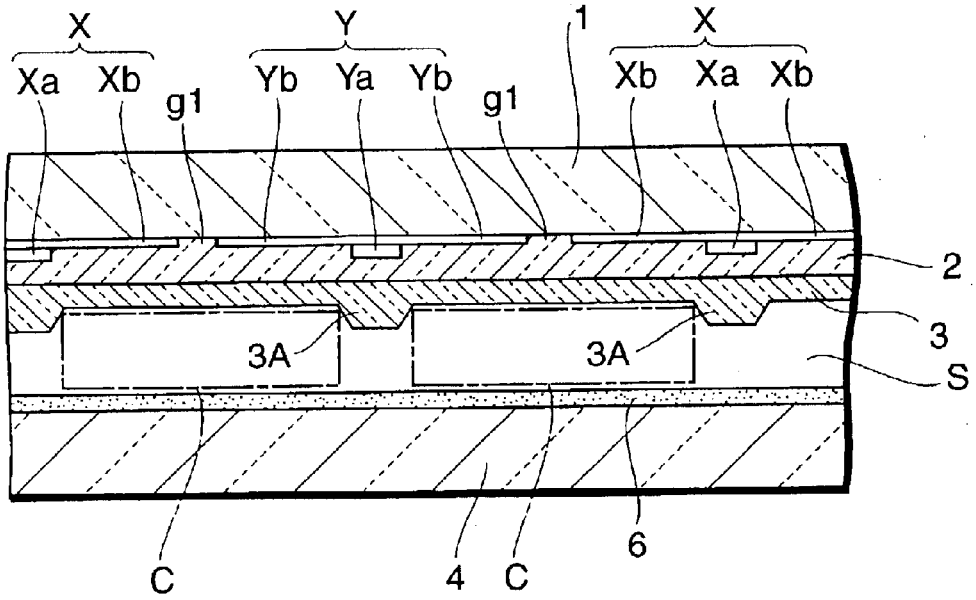
FIG. 3 is a sectional view taken along the V—V line of FIG. 1.

FIG. 1 to FIG. 3 illustrate a first embodiment of a plasma display panel (hereinafter referred to as "PDP") according to the present invention. FIG. 1 is a schematic front view of the PDP in the first embodiment. FIG. 2 is a sectional view taken along the W—W line of FIG. 1. FIG. 3 is a sectional view taken along the V—V line of FIG. 1.

Referring to FIGS. 1 to 3, on a back surface of a front glass substrate 1 serving as a display screen, a plurality of bus electrodes Xa and Ya formed of a metal film each extend in a row direction (the right-left direction in FIG. 1) and are arranged in alternate positions at required intervals in a column direction (the up-down direction in FIG. 1).

A plurality of transparent electrodes Xb, formed of a transparent conductive film made of ITO or the like, are provided on each of the bus electrodes Xa at regular intervals. The transparent electrode Xb extends through the bus electrode Xa along the column direction, and has two T-shaped end parts on both sides of the bus electrode Xa.

Likewise, a plurality of transparent electrodes Yb, formed of a transparent conductive film made of ITO or the like, are provided on each of the bus electrodes Ya in positions each aligned with a position of the transparent electrode Xb of the bus electrode Xa in the column direction. The transparent electrode Yb extends through the bus electrodes Ya along the column direction, and has two T-shaped end parts on both sides of the bus electrode Ya.

The row electrode X is constructed of the bus electrode Xa and the transparent electrodes Xb extending through the bus electrode Xa in the column direction. Likewise, the row electrode Y is constructed of the bus electrode Ya and the transparent electrodes Yb extending through the bus electrode Ya in the column direction.

Each of the transparent electrodes Xb regularly arranged along the bus electrode Xa and the corresponding transparent electrode Yb also regularly arranged along the bus electrode Ya paired with the bus electrode Xa concerned, extend toward each other so that the widened heads of the T shape of the transparent electrodes Xb and Yb are opposite each other with a first discharge gap g1 set at a required distance.

Each row of the facing and paired transparent electrodes Xb and Yb in the row direction forms a display line on the panel.

On the back surface of the front glass substrate 1, a first dielectric layer 2 is provided for covering the row electrodes X and Y.

On the back surface of the first dielectric layer 2, a plurality of column electrode bodies Da are arranged. The column electrode body Da extends opposite and along midpoints between two transparent electrodes Xb and between two transparent electrodes Yb which extend in the column direction and are arranged at a regular interval in the row direction of the row electrodes X and Y.

The column electrode body Da is provided with a column electrode protrusion Db in each portion opposite a side edge of one transparent electrode (e.g. an transparent electrode Xb or Yb on the top side in the display line in FIG. 1) of the facing and paired transparent electrodes Xb and Yb. The column electrode protrusion Db rises from the column electrode body Da toward the front glass substrate 1, and then bends so as to extend its leading end along the back surface of the front glass substrate 1 in the direction of the transparent electrode Xb or Yb to a point opposite to the back of the widened head of the T-shaped transparent electrode with a second discharge gap g2 set at a required distance in between. The column electrode protrusion Db is enclosed in the first dielectric layer 2.

The column electrode body Da and the column electrode protrusions Db form the column electrode D.

A second dielectric layer 3 is formed on the back surface of the first dielectric layer 2 and covers the column electrode bodies Da.

Further, a grid-patterned additional dielectric layer 3A is formed on the back surface of the second dielectric layer 3 and opposite the bus electrodes Xa and Ya and the column electrode bodies Da.

An MgO-made protective layer (not shown) is provided on the back surfaces of the second dielectric layer 3 and the additional dielectric layer 3A.

The front glass substrate 1 is opposite a back glass substrate 4 with a discharge space S in between. The back glass substrate 4 has a surface facing toward the display screen on which a band-shaped partition wall 5 extends in the column direction and opposite the column electrode body Da which is formed on the front glass substrate 1. A leading end-face of the partition wall 5 is in contact with the additional dielectric layer 3A of the second dielectric layer 3 to partition the discharge space S in the row direction.

A phosphor layer 6 is provided on the side faces of the partition walls 5 and the face of the back glass substrate 4 between the two partition walls 5. The red-, green-, and blue-colored phosphor layers 6 are arranged in order in the row direction.

In the PDP, a discharge cell C is formed in each portion of the discharge space S which is sandwiched between the two partition walls 5 and also is opposite the paired transparent electrodes Xb and Yb opposite to each other with the first discharge gap g1 in between.

The discharge space S is filled with a discharge gas including a xenon gas.

The PDP generates an image by the following steps.

In an addressing period after completion of a concurrent reset period, a scan pulse is applied to the row electrodes X and Y in sequence, and a display data pulse corresponding to display data of a video signal is applied to the column electrode bodies Da.

An addressing discharge is then selectively generated between the column electrode protrusion Db and the transparent electrodes Xb or Yb which is opposite the column electrode protrusion Db concerned with the second discharge gap g2 in between. As a result, the discharge cells C in which wall charges are generated on the first and second dielectric layers 2 and 3 (lighted cells) and the discharge cells C in which no wall charge (non-light cells) is formed thereon are distributed over the panel surface.

In the subsequent sustaining emission period, a discharge-sustaining pulse is applied to the row electrodes X and Y, to thereby cause a sustaining discharge between the transparent electrodes Xb and Yb of the row electrodes X and Y, which are opposite to each other with the first discharge gap g1 in between, in each of the discharge cells C having the wall charges formed on the first and second dielectric layers 2 and 3.

The sustaining discharge allows in each lighted cell radiation of vacuum ultraviolet light from the xenon gas included in the discharge gas sealed in the discharge space S. The vacuum ultraviolet light excites the red-, green- or blue-colored phosphor layer 6 to allow it to emit light for the matrix display of an image.

With such configuration of the PDP, in between the adjacent display lines L, the transparent electrodes Xb (Yb) of the row electrode X (Y) share the use of the bus electrode Xa (Ya). That is, only one bus electrode Xa or Ya is disposed between the adjacent display lines L. This design decreases the opposition area s of the intersections of the bus electrodes Xa, Ya and the column electrode bodies Da of the column electrodes D, thereby significantly reducing the capacitance arising from between the bus electrodes and the column electrode bodies.

Figure 4:
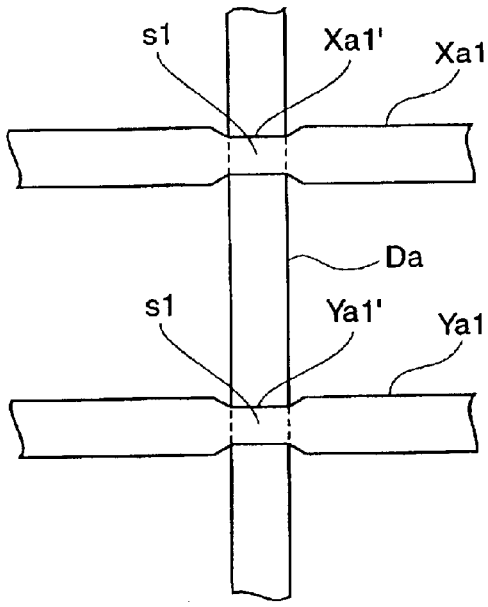
FIG. 4 is a view illustrating an example of modifications of the intersection of a row electrode body and a column electrode body in the first embodiment.

As shown in FIG. 4, the row electrode may be designed such that a bus electrode Xa1 (Ya1) has a width (e.g. 20 $\mu$m to 30 $\mu$m) of a portion Xa1' (Ya1') intersecting with the column electrode body Da smaller than that of the other portions thereof to obtain a reduced opposition area s1 in the intersection.

Figure 5:
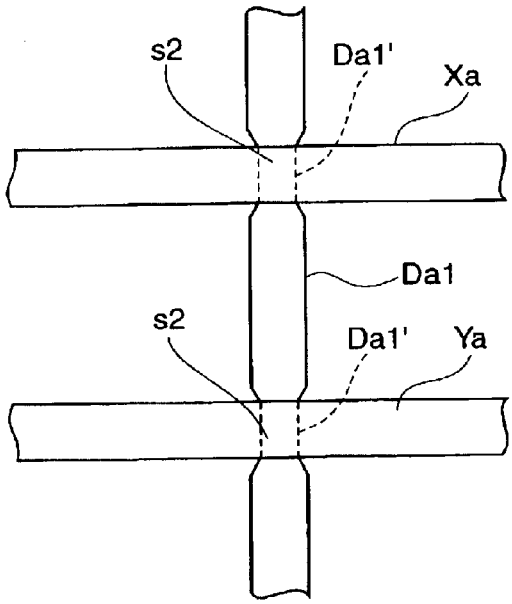
FIG. 5 is a view illustrating another example of the modifications of the intersection of a row electrode body and a column electrode body in the first embodiment.

Alternatively, as shown in FIG. 5, the column electrode may be designed such that a column electrode body Da1 has a width (e.g. 20 μm to 30 μm) of a portion Da1' intersecting with the bus electrode Xa (Ya) smaller than that of the other portions thereof to obtain a reduced opposition area s2 in the intersection.

Figure 6:
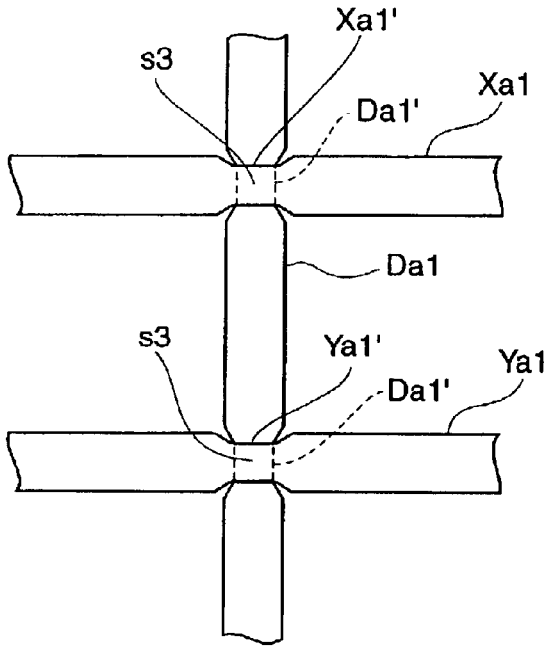
FIG. 6 is a view illustrating yet another example of the modifications of the intersection of a row electrode body and a column electrode body in the first embodiment.

Alternatively, as illustrated in FIG. 6, the row and column electrodes may be designed such that the bus electrode Xa1 (Ya1) and the column electrode body Da1 both have a width (e.g. 20 μm to 30 μm) of the portions Xa1' (Ya1') and Da1' intersecting with each other smaller than that of the other portions thereof to obtain a reduced opposition area s3 in the intersection.

These designs allow a greater reduction of the capacitance arising from the intersection of the bus electrode and the column electrode body.

Further, it is also possible to further reduce the capacitance arising from the intersection of the bus electrode Xa (Ya) and the column electrode D by means of increasing the thickness of the first dielectric layer 2 as compared with that of the second dielectric layer 3 as illustrated in FIG. 2.

Further with the foregoing configuration of the PDP, the area of the non-display zone between the adjacent display lines L has the advantage of being approximately equal to the area of one bus electrode Xa or Ya. This design successfully reduces the spacing between the display lines L to permit an increase in the definition of an image to be generated and also an increase in the area of the display zone of the display cell C for the improvement of the luminous efficiency.

Still further, with the foregoing configuration of the PDP, the formation of the row electrodes X and Y and the column electrodes D on the front glass substrate 1 simplifies the configuration of the back glass substrate 4 for the simplification of the manufacturing process and cost reduction.

In addition, the discharge sections of the row electrode X or Y and the column electrode D are placed near each other and the addressing discharge between the discharge sections is produced without intervention of the phosphor layer 6. This makes it possible to decrease the addressing-discharge starting voltage to enhance the addressing margin, and also to suppress the deterioration of the phosphor layer 6 caused by the ion attack in the addressing discharge.

Figure 7:
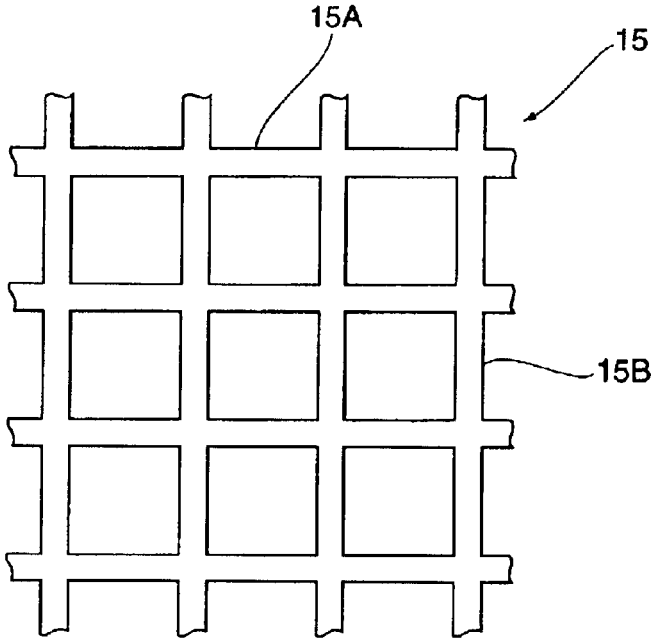
FIG. 7 is a view illustrating an example of modifications of a partition wall in the first embodiment.

In the first embodiment, each of the band-shaped partition walls 5 extends in the column direction to partition the discharge space S in the row direction. However, the discharge space S may be partitioned by a parallel-crosses-patterned partition wall. As illustrated in FIG. 7, the partition wall 15 is constructed of transverse walls 15A each extending in the row direction and opposite the bus electrode Xa or Ya, and vertical walls 15B each extending in the column direction and opposite the column electrode body Da.

Figure 8:
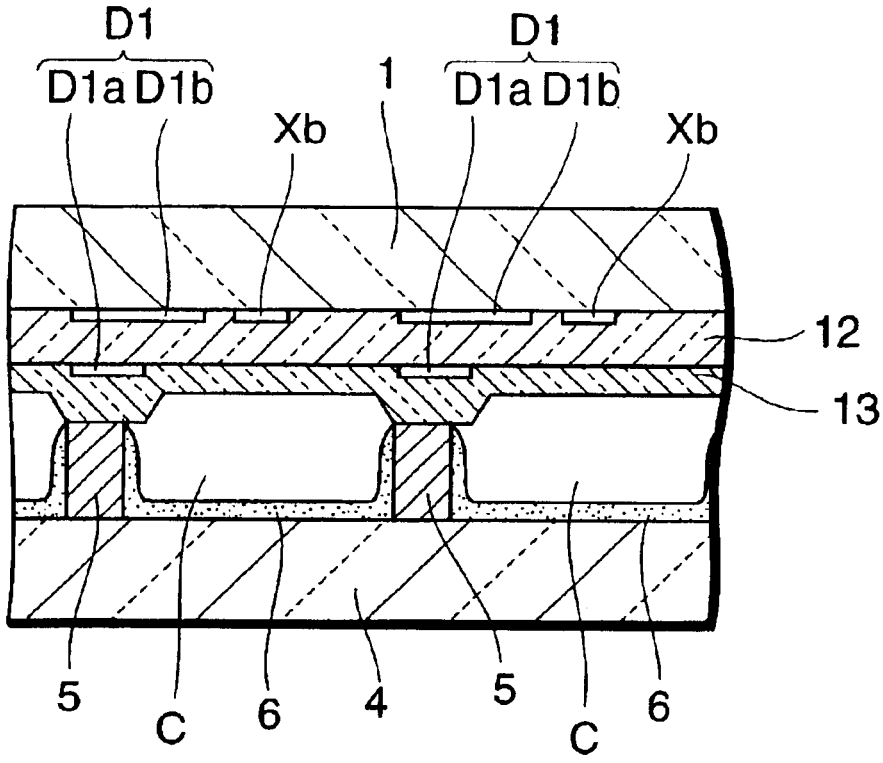
FIG. 8 is a sectional view illustrating a second embodiment according to the present invention.

FIG. 8 is a sectional view illustrating a second embodiment of the PDP according to the present invention, which is taken along the same line as that in FIG. 2 in the first embodiment.

In the PDP of the second embodiment, a column electrode D1 is constituted of a column electrode body D1*a* and column electrode protrusions D1*b* formed separately from the body D1*a*. The column electrode protrusion D1*b*, together with the row electrode, is covered with a first dielectric layer 12. The column electrode body D1*a* is covered with a second dielectric layer 13. The column electrode body D1*a* and the column electrode protrusion D1*b* are coupled in capacitance through the first dielectric layer 12.

The configuration of the other components in the second embodiment is similar to that in the first embodiment and designated by the same reference numerals.

The two-part design of the column electrode body D1*a* and the column electrode protrusion D1*b* of the column electrode D1 allows for the manufacturing steps of sequentially forming the row electrodes X and Y, the column electrode protrusions D1*b*, the first dielectric layer 12, the column electrode bodies D1*a* and the second dielectric layer 13 on the front glass substrate 1, leading to the simplification of the manufacture of the PDP and cost reduction.

The second embodiment makes it possible to stabilize the addressing discharge by means of enlarging the opposition area of the column electrode body D1*a* and the column electrode protrusion D1*b* from which capacitance arises.

Figure 9:
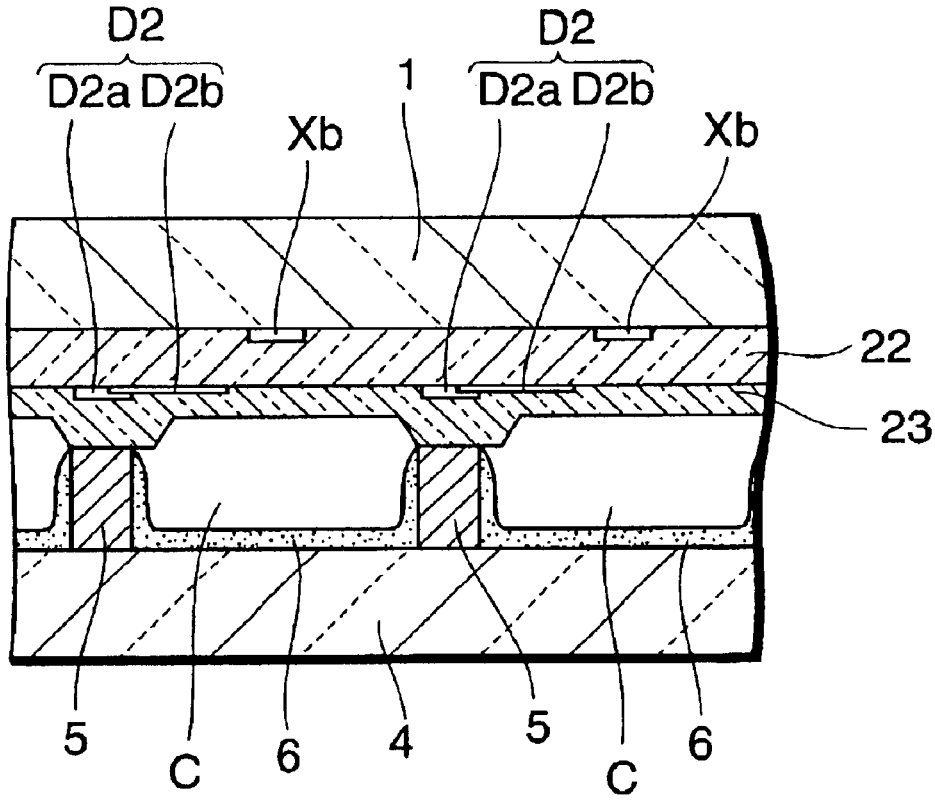
FIG. 9 is a sectional view illustrating a third embodiment according to the present invention.

FIG. 9 is a sectional view illustrating a third embodiment of the PDP according to the present invention, which is taken along the same line as that in FIG. 2 in the first embodiment.

The PDP of the third embodiment is designed such that a column electrode D2 is disposed on the back surface of a first dielectric layer 22, and a column electrode body D2*a* of the column electrode D2 and a column electrode protrusion D2*b* coupled to the column electrode body D2*a* are formed in the same plane (i.e. on the back surface of the first dielectric layer 22) and covered with a second dielectric layer 23.

The configuration of the other components in the third embodiment is similar to that in the first embodiment and designated by the same reference numerals.

In the third embodiment, the manufacturing of the PDP is simplified because the column electrode body D2*a* and the column electrode protrusion D2*b* forming the column electrode D2 are flush with each other.

The column electrode protrusion D2*b* is preferably formed of a transparent electrode made of ITO or the like, but can be formed of a metal electrode to be integral with the column electrode body D2*a*.

The terms and description used herein are set forth by way of illustration only and are not meant as limitations. Those skilled in the art will recognize that numerous variations are possible within the spirit and scope of the invention as defined in the following claims.

What is claimed is:

1. A plasma display panel comprising:

a pair of first and second substrates opposite each other with a discharge space in between;

a plurality of row electrode bodies provided on an inner surface of the first substrate, and each extending in a row direction and arranged at required intervals in a column direction;

a plurality of row electrode jutting parts provided on the inner surface of the first substrate, and connected to each of the row electrode bodies at required intervals, and each protruding from the row electrode body in the column direction on both sides of the row electrode body;

a plurality of column electrodes provided on the inner surface of the first substrate, and each separated from the row electrode body through a dielectric layer, covering the row electrode bodies and the row electrode jutting parts, in a thickness direction of the first substrate, and also disposed opposite a midpoint of the row electrode jutting parts adjacent to each other in the row direction, a leading end of each of the row electrode jutting parts being opposite a leading end of the corresponding row electrode jutting part, connected to the row electrode body adjacent thereto, with a first discharge gap interposed in between, and one of the row electrode jutting parts facing and paired with each other being opposite the column electrode with a second discharge gap interposed in between; and phosphor layers each provided on a surface of the second substrate facing the first substrate and at a position opposite the paired row electrode jutting parts opposite to each other with the first gap in between.

2. A plasma display panel according to claim 1, wherein at least one of the two, either said column electrode or said row electrode body, has a width of a portion intersecting with the column electrode or the row electrode body smaller than that of other portions thereof.

3. A plasma display panel according to claim 2, wherein said row electrode body has the width of the portion intersecting with said column electrode smaller than that of the other portions thereof.

4. A plasma display panel according to claim 2, wherein said column electrode has the width of the portion intersecting with said row electrode body smaller than that of the other portions thereof.

5. A plasma display panel according to claim 2, wherein said column electrode and the row electrode body each have the width of the portion intersecting with the other smaller than the width of the other portions thereof.

6. A plasma display panel according to claim 1, wherein said column electrode has a column electrode body extending in the column direction, and column electrode protrusions each electrically connected to the column electrode body and located opposite said row electrode jutting part, connected to one of said paired row electrode bodies, with the second discharge gap interposed in between.

7. A plasma display panel according to claim 6, wherein said row electrode body and said row electrode jutting part are covered with a first dielectric layer, and at least said column electrode body of said column electrode is covered with a second dielectric layer formed on a back surface of the first dielectric layer.

8. A plasma display panel according to claim 7, wherein said first dielectric layer has a thickness larger than that of said second dielectric layer.

9. A plasma display panel according to claim 6, wherein said column electrode protrusion is formed to be flush with said row electrode jutting part, and coupled to said column electrode body.

10. A plasma display panel according to claim 6, wherein said column electrode protrusion is formed to be flush with said column electrode body and coupled to the column electrode body.

11. A plasma display panel according to claim 6, wherein said column electrode protrusion is formed to be flush with said row electrode jutting part, and coupled in capacitance to said column electrode body through the dielectric layer.

12. A plasma display panel according to claim 6, wherein said row electrode jutting part has a base end connected to said row electrode body and having a width smaller than that of said leading end thereof in the row direction, and the widened heads of the leading ends are opposite each other with the first discharge gap in between, and wherein said column electrode protrusion is formed opposite the widened head of the row electrode jutting part.

13. A plasma display panel according to claim 1, further comprising a partition wall provided on the surface of said second substrate facing said first substrate and opposite at least one of said row electrode body and said column electrode, and extending in one of the row and column directions to partition said discharge space defined between said first and second substrates.

* * * * *